US006281911B1

(12) United States Patent
Nakazawa et al.

(10) Patent No.: US 6,281,911 B1
(45) **Date of Patent: *Aug. 28, 2001**

(54) INK CARTRIDGE HAVING WASTE INK ABSORBING FUNCTION

(75) Inventors: Chiyoshige Nakazawa; Manabu Yamada; Yukihiro Hanaoka; Atsushi Nishioka; Katsuko Aoki, all of Suwa (JP)

(73) Assignee: Seiko Epson Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/297,161

(22) PCT Filed: Aug. 28, 1998

(86) PCT No.: PCT/JP98/03829

§ 371 Date: May 28, 1999

§ 102(e) Date: May 28, 1999

(87) PCT Pub. No.: WO99/11462

PCT Pub. Date: Mar. 11, 1999

(30) Foreign Application Priority Data

Aug. 28, 1997 (JP) ..... 9-232637
Oct. 31, 1997 (JP) ..... 9-299977

(51) Int. Cl.[7] ..... B41J 2/165
(52) U.S. Cl. ..... 347/36; 347/86

(58) Field of Search ..... 347/36, 86

(56) References Cited

U.S. PATENT DOCUMENTS 5,157,421 * 10/1992 Kitahara ..... 347/86
5,221,935 * 6/1993 Uzita ..... 347/36
5,400,066 3/1995 Matsumoto et al. ..... 347/86

FOREIGN PATENT DOCUMENTS 0 710 561 A2 8/1996 (EP) .
5-16377 1/1993 (JP) .
6-226991 8/1994 (JP) .
61-12352 1/1996 (JP) .
2586016 5/1998 (JP) .

* cited by examiner

*Primary Examiner*—N. Le
*Assistant Examiner*—Shih-wen Hsieh
(74) *Attorney, Agent, or Firm*—Nixon & Vanderhye P.C.

(57) ABSTRACT

An ink cartridge 2 with a waste ink absorbing function includes a division room 70 formed in the interior portion of a cartridge case 30 for storing a waste ink absorbing member 20, and a plastic film 60 forming at least part of the division room 70. By cutting or peeling off the plastic film 60, the waste ink absorbing member 20 stored within can be replaced, which simplifies the replacement of the waste ink absorbing member 20. After replacement, the plastic film 60 may be mounted onto the cartridge case 30. Use of the plastic film is economical when compared with a structure in which a plastic plate is mounted onto a cartridge case. Also, the ink cartridge 2 can be reduced in size and weight as a whole.

21 Claims, 11 Drawing Sheets

INK CARTRIDGE HAVING WASTE INK ABSORBING FUNCTION

BACKGROUND OF THE INVENTION

1. Field of the Invention

The present invention relates to an ink cartridge for use as an ink supply source in an ink recording apparatus such as an ink jet printer or the like and, in particular, an ink cartridge having a waste ink absorbing function.

2. Description of the Related Prior Art

As an ink supply mechanism for use in an ink jet printer, there is conventionally known an ink supply mechanism structured such that an ink supply needle is previously disposed in an ink cartridge mounting portion formed in the ink jet printer, and, if an ink cartridge is mounted in such a manner that the ink supply needle can be inserted into an ink take-out port formed in the ink cartridge, then ink stored within the ink cartridge can be supplied to an ink jet head provided in the ink jet printer.

This type of ink cartridge for use in an ink jet printer is disclosed, for example, in Japanese Patent Publication No. 5-162333 of Heisei. In particular, in the ink tank cartridge disclosed in the present patent publication, as shown in FIG. 1 of the specification thereof, an ink bag and an ink absorbing member are stored within a rectangular-shaped inside space to be defined by upper and lower box bodies which cooperate together in forming the ink cartridge. The ink absorbing member is used to absorb the ink that leaks out from an ink guide needle (ink supply needle) which is inserted into the ink cartridge, thereby preventing such ink from leaking externally of the ink cartridge.

Also, as an ink cartridge having a waste ink absorbing function, there is known an ink cartridge which is disclosed in Japanese Patent Publication No. 63-116833 of Showa filed by the present applicant. That is, the ink vessel (ink cartridge) disclosed in the present patent publication is structured such that a space formed in the interior portion of a case for the ink cartridge is divided into two sections by a middle cover; in particular, an ink storage bag is stored in one of the two divided sections, whereas a waste ink absorbing member is stored in the other. The space section, in which the waste ink is stored, is defined by the case, middle cover, and an upper cover which is mounted on the case, so that the present space section provides a hermetically closed space or an airtight space. Or, the present space section is defined by a case which is divided to two sections, and a middle cover, so that the present space section provides a hermetically closed space. Here, in order to connect the plastics-made case and upper cover, or to connect together the two divided sections of the plastics-made case, there is employed an ultrasonic sealing method.

However, in the former structure, that is, in the ink cartridge disclosed in Japanese Patent Publication No. 5-162333 of Heisei, there is a fear that the waste ink absorbed by the ink absorbing member can leak out through the connected portions between the upper and lower box bodies. On the other hand, in the latter, that is, in the ink cartridge of a type that is disclosed in Japanese Patent Publication No. 63-116833 of Showa, the space, in which the ink absorbing member is stored, is substantially an airtight space because the connected portions of the members are sealed using ultrasonic waves and, therefore, there is no fear that the ink can leak. However, in the latter, there are still left the following problems that must be solved.

That is, firstly, generally, the ink cartridge is recycled. To recycle the ink cartridge, it is necessary to execute an operation in which the case for the ink cartridge is easily opened, the ink bag and ink absorbing member are replaced with new ones and, after then, the case is closed again. It is desirable to be able to carry out such operation simply and economically. However, as described above, in the structure in which the two cases, or the case and upper cover are connected together by an ultrasonic sealing method, when replacing the ink bag and ink absorbing member, the case and upper cover cannot be opened simply. Also, when the case and upper cover are opened once, in many cases, the welded portions of the two cases, or the welded portions of the case and upper cover can be damaged, which makes it impossible to recycle the ink cartridge; that is, the ink cartridge having such structure must be wasted and thus use of such ink cartridge is not economical. Further, there is another problem that to execute the ultrasonic sealing operation requires a large-scale installation.

Secondly, to provide a partition plate such as the middle cover or the like for dividing the interior portion of the ink cartridge case is not desirable from the point of view of reducing the weight and size of the ink cartridge.

Thirdly, generally, if the ink absorbing member absorbs ink, then it will expand in volume by an amount equivalent to the ink absorbed. For this reason, it is necessary that the ink absorbing member portion of the ink cartridge has been previously formed with such room as corresponds to the expansion of the ink absorbing member, which makes it necessary to increase the thickness of the ink cartridge by an amount equivalent to such room. However, this is not desirable from the point of view of reducing the size of the ink cartridge.

Fourthly, in some of the ink cartridges that have been used and collected for recycling, waste ink is little collected in the ink absorbing members thereof. However, even in such cases, conventionally, if the waste ink absorbing members thereof are contaminated with waste ink to any degree, the ink absorbing members are replaced with new ones. Therefore, even the waste ink absorbing member, the most part of which has not absorbed waste ink and thus is still capable of absorbing the waste ink, is taken out from the ink cartridge and is wasted as it is.

SUMMARY OF THE INVENTION

In view of the above, it is an object of the invention to provide an ink cartridge with a waste ink absorbing function which can be recycled simply and economically.

Also, it is another object of the invention to provide an ink cartridge with a waste ink absorbing function which can be advantageously reduced in weight and size.

Means for Solving the Problems

In attaining the above object, according to the invention, there is provided an ink cartridge with a waste ink absorbing function, which comprises: an ink bag with ink stored therein, a waste ink absorbing member for absorbing waste ink, and a cartridge case storing therein the ink bag and waste ink absorbing member; and, which is characterized by a division room defined in the interior portion of the cartridge case for storing the waste ink absorbing member therein, and a plastic film forming at least a portion of the division room.

According to the ink cartridge structured in this manner, simply by cutting or peeling off the plastic film, the waste ink absorbing member disposed within the division room can be replaced. Therefore, when compared with the conventional ink cartridge in which the storage portion for the waste ink absorbing member is defined by welding a plastic plate or the like to the cartridge case, the replacement of the waste ink absorbing member can be simplified. Also, after replacement, a new plastic film may be simply mounted onto the cartridge case, which is economical when compared with the conventional ink cartridge using the plastic plate or the like. Further, when compared with the conventional ink cartridge using the plastic plate or the like, the ink cartridge can be reduced in size and weight as a whole.

Here, the present cartridge case typically includes first and second case sections which are combined together to thereby define the storage portions of the cartridge case respectively for storing the ink bag and waste ink absorbing member.

Also, the typical outer shape of the present cartridge case first case is formed in a thin rectangular parallelpiped shape. In particular, according to this typical structure, the first case section may include a rectangular-shaped case bottom plate portion and a case outer frame portion formed in the peripheral edge of the case bottom plate portion, and the second case section may include a rectangular-shaped case cover portion and a case inner frame portion formed in the peripheral edge of the case cover portion. Also, the case inner frame portion may be set smaller in width than the case outer frame portion and may be formed in a size which allows the case inner frame portion to be inserted into the case outer frame portion. Further, the waste ink absorbing member may be stored within a rectangular-shaped recess which is defined by the case cover portion and case inner frame portion of the second case section, and the opening of the present recess may be closed by the plastic film.

In this structure, if the peripheral edge portion of the plastic film is thermally welded to the opening end face of the case inner frame portion which defines the opening of the recess, then the division room with the waste ink absorbing member stored therein can be closed hermetically, thereby being able to surely prevent the waste ink from leaking externally of the division room.

When the division room with the waste ink absorbing member stored therein is closed hermetically in this manner, preferably, the first and second case sections may be removably combined together in a snap fit manner or the like. With use of this structure, when recycling the ink cartridge, an operation to open and close the cartridge case can be simplified and also the cartridge case can be prevented against damage.

Here, when the division room with the waste ink absorbing member stored therein is formed in the above-mentioned hermetically closed manner, preferably, in the plastic film, there may be formed a ventilation hole in order to prevent such hermetically closed condition from impairing the waste ink absorbing performance of the waste ink absorbing member. In this case, in order to prevent the ink from leaking from the ventilation hole portion of the plastic film, the ventilation hole may be formed in the portion of the plastic film that faces the portion of the waste ink absorbing member where the waste ink is absorbed latest in time.

On the other hand, the plastic film used in the present invention, preferably, may be structured in the following manner.

At first, in order to enhance the waste ink absorbing performance of the waste ink absorbing member, preferably, the plastic film may have such permeability as equivalent to at least the cartridge case. That is, since 70–80% of the volume of ink is generally occupied by water, if the water can be discharged outside, then the waste ink absorbing amount of the waste ink absorbing member can be increased by an amount corresponding to the discharged water. Therefore, to discharge the water outside, it is preferred that the plastic film may be formed permeable.

Also, in the case when the plastic film is thermally welded to the cartridge case, in order to enhance the connecting force thereof, preferably, the plastic film may be formed of the same material as the cartridge case.

Here, the plastic film may also have a laminated structure. For example, the plastic film may include first and second film layers; and, in particular, the first film layer may be formed of the same material as the cartridge case and may be thermally welded to the cartridge case, while the second film layer may be formed of permeable material.

Further, the plastic film may also have a three-layer structure. In this case, preferably, between the above-mentioned first and second film layers, or on the surface of the above-mentioned second film layer, there may be disposed a third film layer, while the third film layer may be formed of material which is higher in shock resistance than the first and second film layers.

And, when the plastic film is so formed as to have a multi-layer structure, preferably, the above-mentioned second film layer may be formed of material the melting temperature of which is higher than that of the first film layer. In this case, even if the first film layer disposed on the cartridge case side is melted and welded to the cartridge case due to the heat that is produced by a heater for thermal welding, the second film layer disposed on the heater side will not be melted and thus not attached to the heater, which enhances the efficiency of the thermally welding operation.

On the other hand, the plastic film which defines part of the division room with the waste ink absorbing member stored therein, preferably, may be set in a slackened manner. That is, when the ink absorbing member increases in volume as it absorbs ink, such increase in the volume of the ink absorbing member can be absorbed by the slackening of the plastic film.

Also, preferably, as the plastic film, there may be used a transparent plastic film. The reason for this is that, if a transparent plastic film is used, the sealed condition after thermal welding can be confirmed visually.

Further, preferably, the waste ink absorbing member may be previously divided into a plurality of sections and, after then, the waste ink absorbing member sections may be stored into the division room; or, there may be formed one or more breaks in the waste ink absorbing member so that the waste ink absorbing member can be divided into a plurality of sections. If the waste ink absorbing member is formed in this manner, when the ink cartridge is collected for recycling, only the used portion(s) of the waste ink absorbing member can be replaced with a new ink absorbing member, while the unused portion(s) thereof can be used again in a simple manner.

BRIEF DESCRIPTION OF THE DRAWINGS

FIG. 3 (B) is a partially enlarged section view of a portion of a plastic film employed in the invention;

DETAILED DESCRIPTION OF THE MOST PREFERRED EMBODIMENT OF THE INVENTION

Now, description will be given below in detail of the most preferred embodiment of an ink cartridge with a waste ink absorbing function for use in an ink jet printer according to the invention with reference to the accompanying drawings.

Figure 3A:
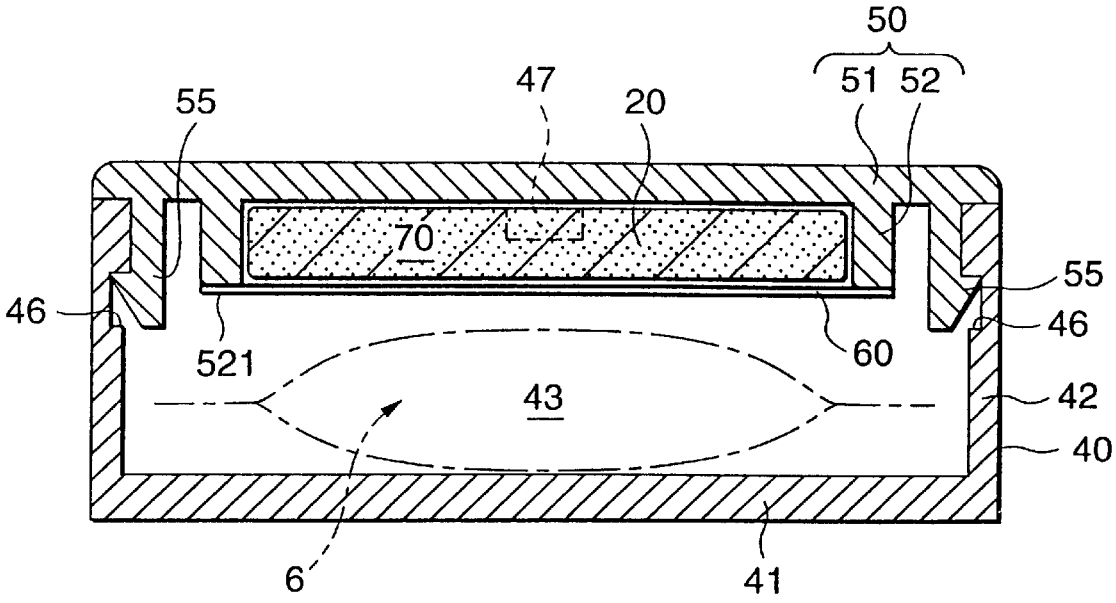
FIG. 3 (A) is a schematically sectional view of the ink cartridge.
Figure 3B:
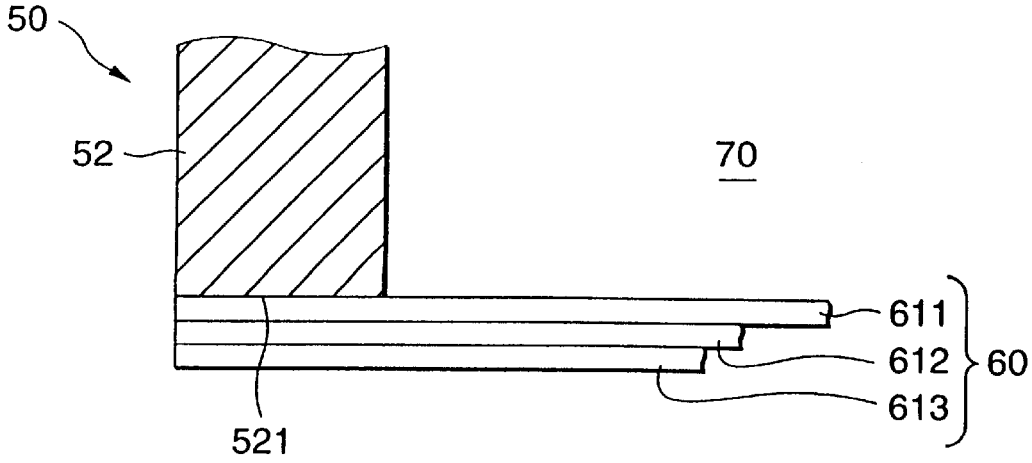
Figure 4:
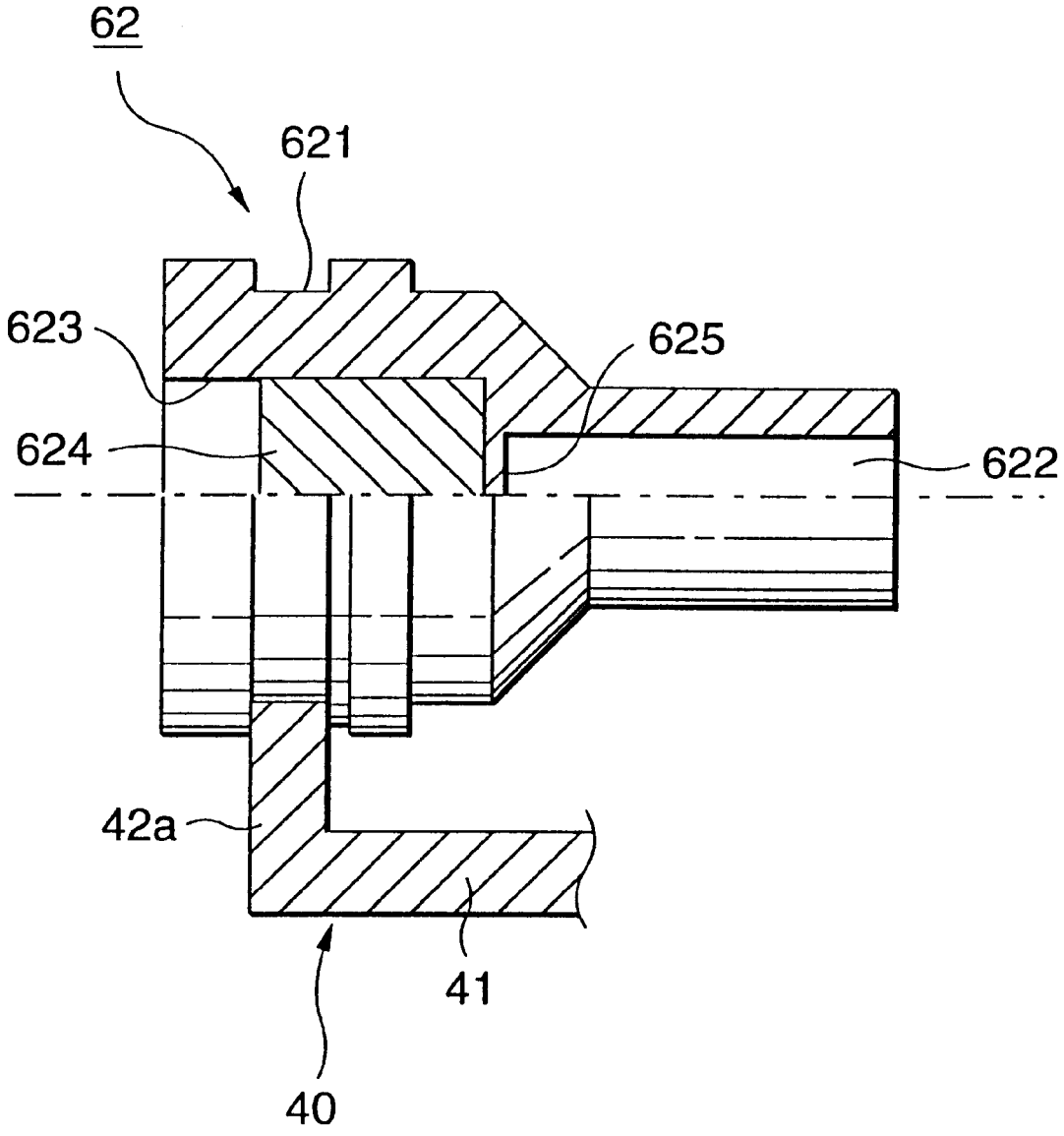
FIG. 4 is a partially sectional view of the ink take-out port portion of the ink cartridge.
Figure 5:
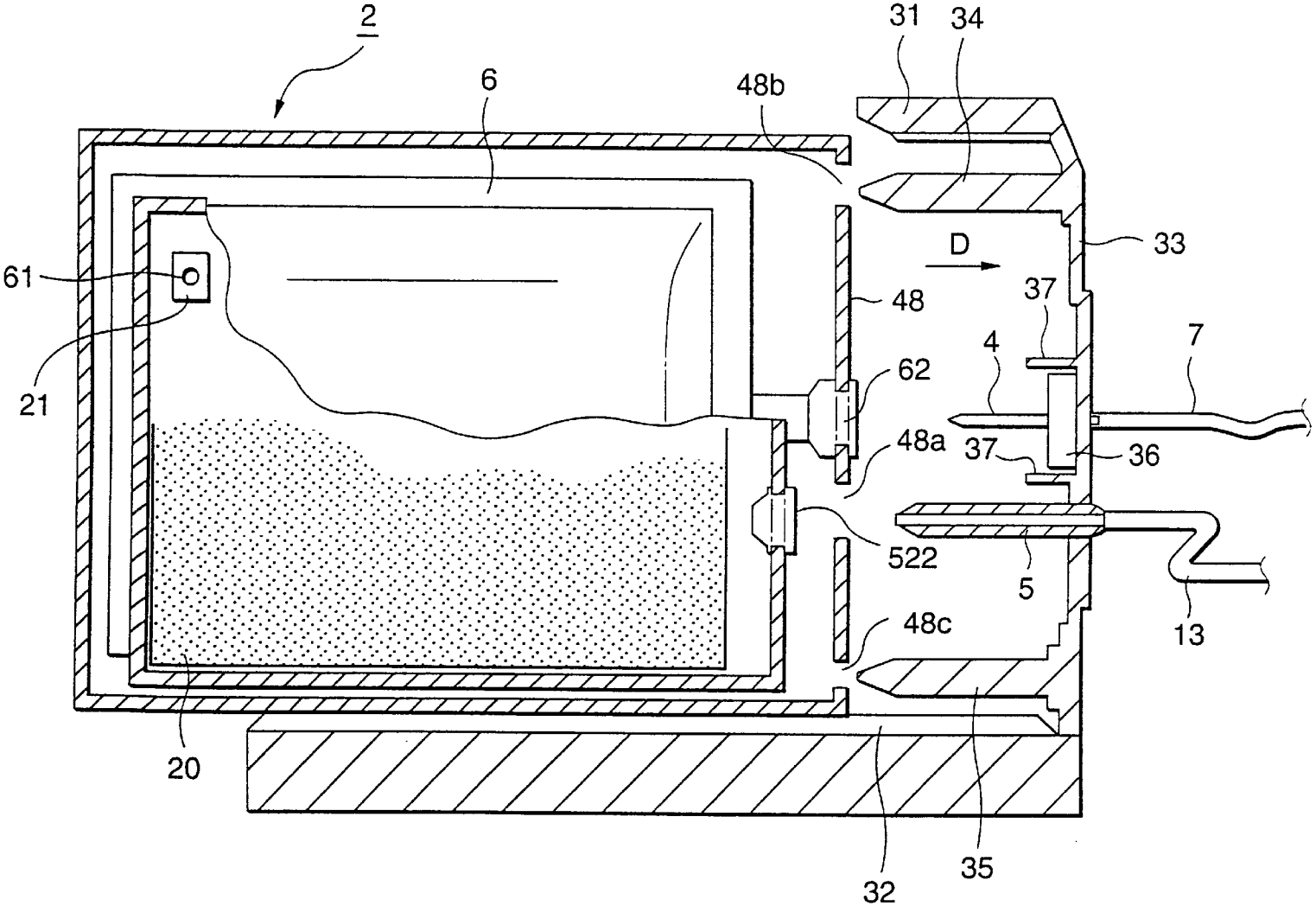
FIG. 5 is an explanatory view of an operation to insert the ink cartridge into the ink cartridge mounting portion of an ink jet printer.
Figure 6:
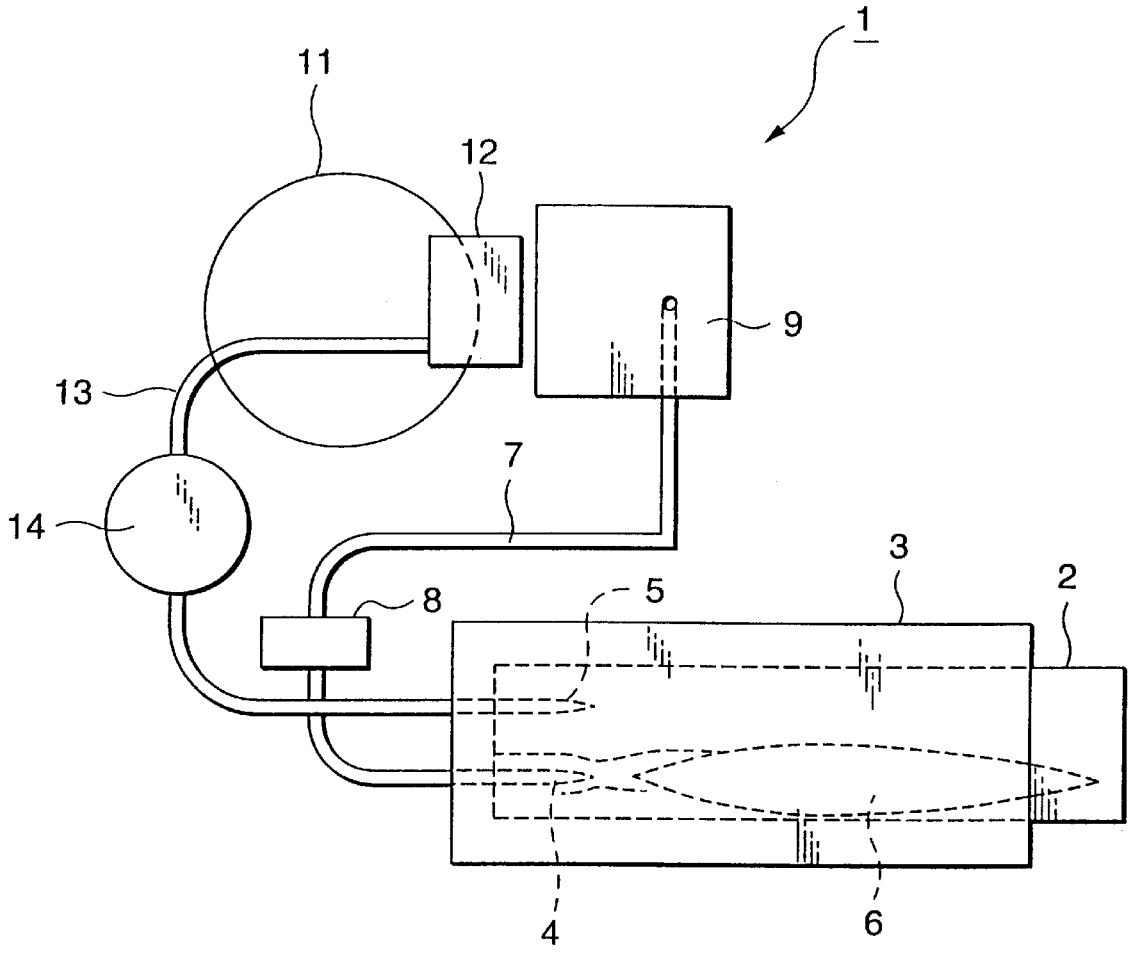
FIG. 6 is an explanatory view of an ink supply and discharge system provided by inserting the ink cartridge into the ink cartridge mounting portion of the ink jet printer.

Here, FIGS. 1 to 4 respectively show an ink cartridge with a waste ink absorbing function according to the invention, and FIG. 5 is an explanatory view of the present ink cartridge, in which it is shown together with an ink cartridge mounting portion formed in an inkjet printer. On the other hand, FIG. 6 is a schematic view of an ink supply and discharge system provided in an ink jet printer which uses, as an ink supply source, an ink cartridge with a waste ink absorbing function according to the invention.

Ink Supply and Discharge System

At first, description will be given below of an ink supply and discharge system provided over the whole of an ink jet printer with reference to FIG. 6. Here, an ink jet printer 1 shown in FIG. 6 is basically similar in structure to an ink jet printer which is generally used and, therefore, the description thereof is omitted here. Now, in the ink jet printer 1, there is disposed a cartridge mounting portion 3 in which an ink cartridge 2 can be removably mounted. In the cartridge mounting portion 3, there are mounted an ink supply needle 4 and a waste liquid needle 5 in such a manner that, for example, they extend horizontally. If the ink cartridge 2 is slided horizontally with respect to the two needles 4 and 5 to thereby insert the two needles 4 and 5 into their respective given portions (to be discussed later) of the ink cartridge 2, then there is formed an ink flow passage between the ink cartridge 2 and ink jet printer 1.

After the ink flow passage is formed, ink stored in an ink bag 6 stored in the ink cartridge 2 is taken out into an ink supply tube 7 through the ink supply needle 4. In the intermediate portion of the ink supply tube 7, there is disposed a filter 8 which is used to filter dust and foreign substance from the ink.

The ink is guided to a print head 9 of the ink jet printer 1 by the ink supply tube 7. The print head 9 is held by a carriage (not shown) and can be moved reciprocatingly in the longitudinal direction thereof along the surface of a platen 11. In operation, a recording sheet (not shown) is fed along the surface of the platen 11 in a direction at right angles to the moving direction of the print head 9, and printing is executed on the recording sheet by the print head 9.

Here, in order to keep the print quality of the print head 9, the ink nozzle of the print head 9 is cleaned (wiped) and the ink is sucked. For this purpose, a head cap 12 is disposed at a position out of the moving range of the print head 9 for printing, while the print head 9 is moved periodically up to the position of the head cap 12. To the head cap 12, there is connected a waste liquid tube 13 which is used to collect from the head cap 12 the waste ink that has been collected or sucked from the print head 9. In the intermediate portion of the waste liquid tube 13, there is disposed a waste liquid pump 14 which serves as a drive source for collecting the waste ink.

The waste ink, which has been collected by the waste liquid pump 14 through the waste liquid tube 13, is absorbed through the waste liquid needle 5 by a waste ink absorbing member (to be discussed later) stored in the ink cartridge 2 and is thereby collected here.

Ink Cartridge

Figure 1:
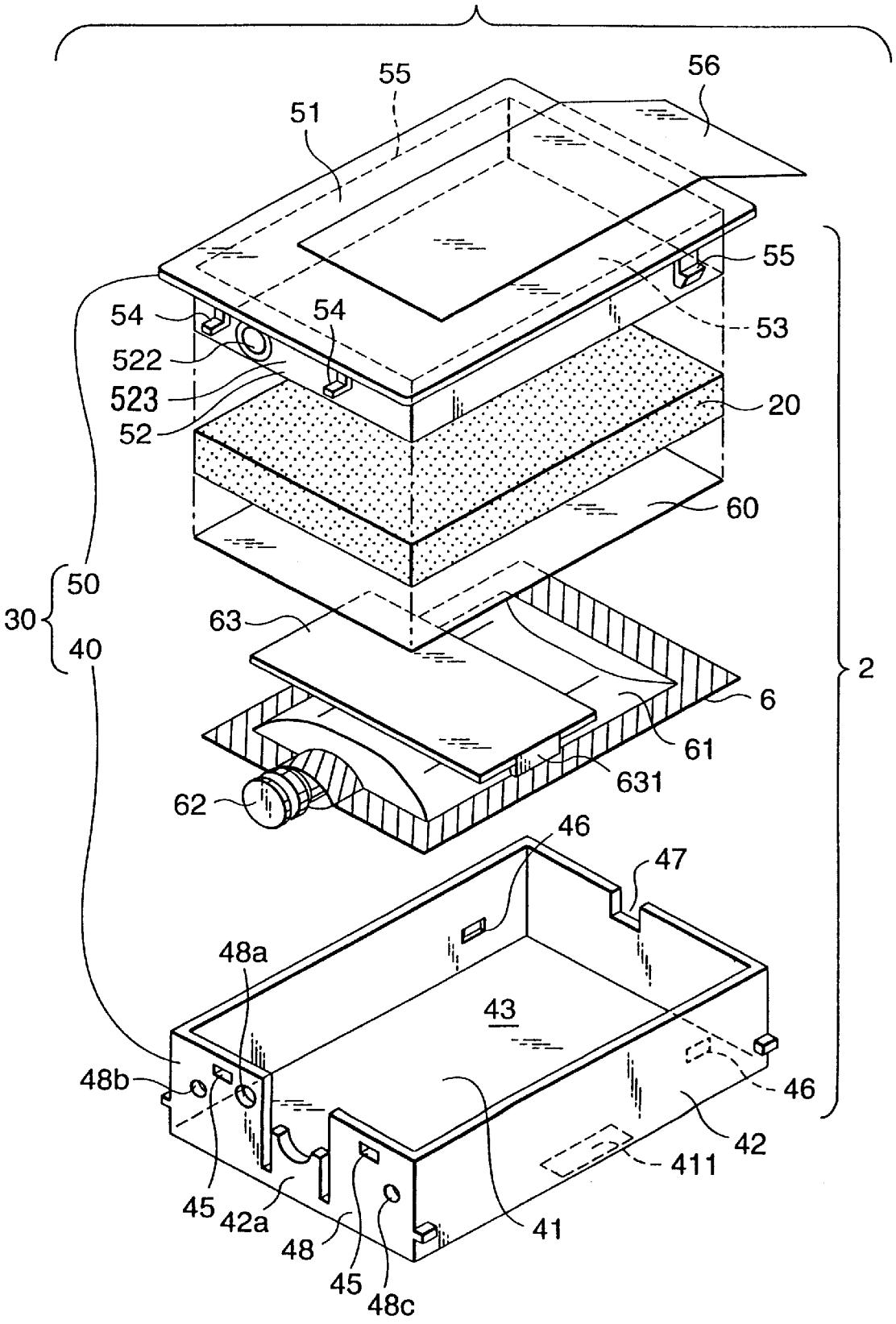
FIG. 1 is an exploded perspective view of an ink cartridge according to the invention.
Figure 2:
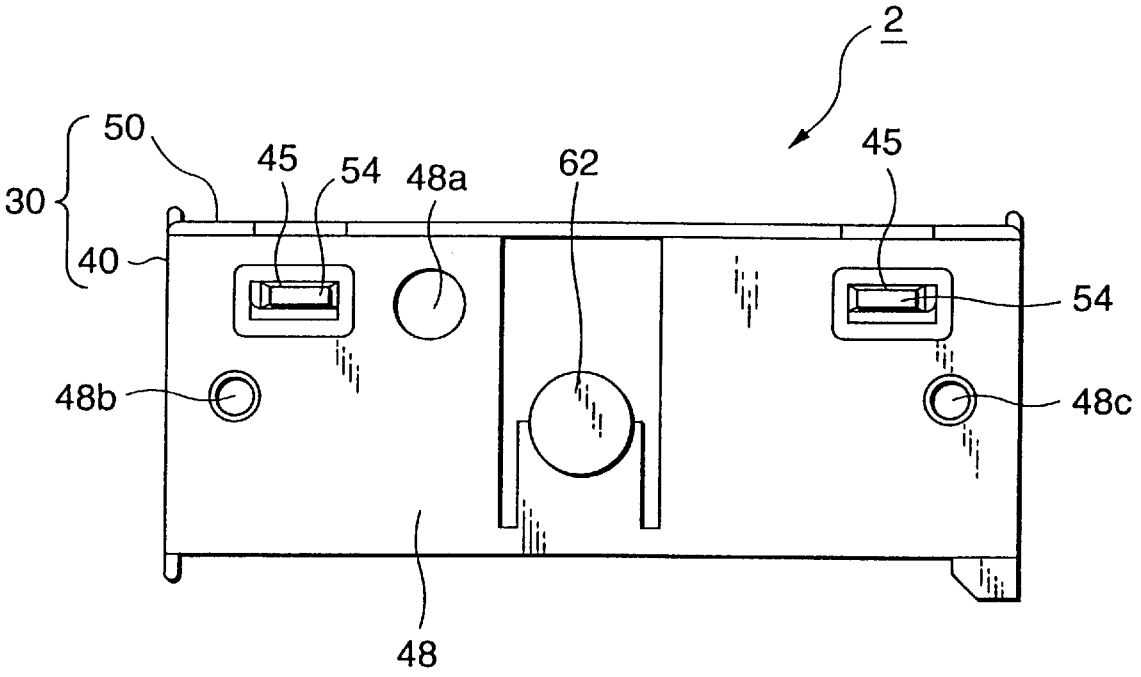
FIG. 2 is a front view of the ink take-out port side of the ink cartridge shown in FIG. 1.

Now, description will be given below of the whole structure of the ink cartridge 2 with reference to FIGS. 1 to 4. In particular, FIG. 1 is an exploded perspective view of the ink cartridge 2, FIG. 2 is a front view of the ink cartridge 2, when it is viewed from the ink take-out port side thereof, FIG. 3 is a schematic section view of the ink cartridge 2, and FIG. 4 is a partially sectional view of the ink take-out port portion of the ink cartridge 2.

As shown in FIGS. 1 to 4, the ink cartridge 2 comprises an ink bag 6 which stores ink therein, a waste ink absorbing member 20 for absorbing waste ink, and a cartridge case 30 in which the ink bag 6 and waste ink absorbing member 20 are stored. The cartridge case 30 comprises a case main body 40 (a first case section) and a cover 50 (a second case section) which are combined together to thereby define two storage portions in which the ink bag 6 and waste ink absorbing member 20 are respectively to be stored.

The case main body 40 includes a rectangular-shaped case bottom plate portion 41 and a case outer frame portion 42 standing up at right angles from the peripheral edge of the case bottom plate portion 41. The case bottom plate portion 41 and case outer frame portion 42 cooperate together in defining a rectangular-shaped recess 43, while the ink bag 6 is stored in the recess 43. On the other hand, the cover 50 includes a rectangular-shaped case cover portion 51 having the same size as the case main body 40, and a case inner frame portion 52 which stands up at a position inside the peripheral edge of the case cover portion 51 at right angles to the peripheral edge of the case cover portion 51. The case inner frame portion 52 is set in a size which allows the case inner frame portion 52 to be inserted inside the case outer frame portion 42, and the width of the case inner frame portion 52 is set greatly smaller than the width of the case outer frame portion 42.

The case cover portion 51 and case inner frame portion 52 of the cover 50 cooperate together in forming a rectangular-shaped recess 53 and, in the recess 53, there is stored the waste ink absorbing member 20 having a size and a thickness which allows the waste ink absorbing member to be just fitted into the recess 53, while the opening of the recess 53 is closed by a rectangular-shaped plastic film 60. That is, the recess 53 and plastic film 60 cooperate together in forming a division room 70 (see FIG. 3) for storing a waste ink absorbing member 20.

Next, description will be given below in detail of the structures of the respective components of the ink cartridge 2. At first, the ink bag 6 is formed of flexible material; in particular, for the purpose of enhancing its gas barrier property, the ink bag 6 is composed of an aluminum laminated film in which an aluminum foil is sandwiched by two films, for example, the outside of the aluminum foil is held by a nylon film, while the inside thereof is held by a polyethylene film. In the illustrated example, two sheets of aluminum laminated films are superimposed on top of each other and they are then connected together by thermal welding or by other similar means to thereby produce the main body portion 61 of the ink bag 6. In the portion of the mutually connected portion of the two aluminum laminated films, which is shown by oblique lines in FIG. 1, in more particular, in the ink bag front edge portion, there is mounted by thermal welding or by other similar means an ink take-out port 62 which guides the ink within the ink bag 6 to the outside.

The ink take-out port 62 can be composed of a plastic molding or the like. In the ink take-out port 62, as can be seen from FIG. 4, there is formed a fixing groove 621 which is used to fix the ink bag 6 to a given position with respect to the case main body 40 of the cartridge case 30. The fixing groove 621 is formed on the outer peripheral surface of the ink take-out port 62 in an annular shape, while it can be fitted with and held by a fitting portion 42*a* which is formed in the case main body 40. The ink take-out port 62 includes a pipe portion 622 for guiding the ink within the ink bag 6 therefrom, and a take-out port rubber 624 formed of elastic material such as rubber or the like which is fitted into a large-diameter opening 623 formed in the leading end portion of the pipe portion 622, while the ink is sealed by the take-out port rubber 624. Between the pipe portion 622 and take-out port rubber 624, there is interposed a thin film portion 625 which prevents the ink from touching the take-out port rubber 624 directly; that is, due to the thin film portion 625, there is eliminated the possibility that the ink can touch the take-out port rubber 624 directly to denature the same to thereby elute and separate impurities therefrom, resulting in the poor printing of the print head 9. By the way, the rear end portion of the ink bag 6 is fixed to the case main body 40 side by double-side adhesive tape (not shown) or the like.

As shown in FIG. 1, a detect plate 63 is fixed to the ink bag 6 by fixing means (not shown) such as double-side adhesive tape or the like. The detect plate 63 is used to detect that the amount of the ink left within the ink bag 6 has been reduced down to a previously set amount. The detect plate 63 includes a detecting projection 631 which can project externally out of an opening 411 formed in the bottom portion 41 of the case main body 40 as the ink residual amount reduces: that is, if the projecting amount of the detecting projection 631 reaches or exceeds a given amount, then the detecting projection 631 is detected by an ink end detect mechanism (not shown), thereby being able to judge that the ink has run out.

Next, description will be given below of a connecting mechanism for connecting the case main body 40 and cover 50 with reference to FIGS. 1 to 3. The cover 50 includes, at the outside positions of the inner frame portion 52 of the case cover portion 51, a pair of securing pawls 54 formed on the front end edge side thereof and extending at right angles to the inner frame portion 52, and a pair of securing pawls 55 formed on the two sides of the rear end portion thereof and similarly extending at right angles to the inner frame portion 52. On the other hand, the case main body 40 includes a pair of securing holes 45 into which the securing pawls 54 of the cover 50 can be snap fitted from inside, and a pair of securing grooves 46 into which the securing pawls 55 of the cover 50 can also be snap fitted from inside. Therefore, to mount the cover 50 onto the case main body 40, at first, the securing pawls 54 may be fitted into the securing holes 45 respectively and, next, the securing pawls 55 may be fitted into the securing grooves 46 respectively.

To remove the cover 50 from the case main body 40, after a jig is inserted into a notch 47 formed in the central portion of the rear end wall of the outer case frame portion 42 of the case main body 40, if the cover 50 is forced open using the jig, then the cover 50 can be removed simply. By the way, a label 56 with instructions and the like printed thereon may be bonded to the surface of the case cover portion 51 of the cover 50, so that the notch 47 can be covered by the label 56.

In the ink cartridge according to the present embodiment, the case main body and cover, which cooperate together in forming the present ink cartridge, are removably connected together by snap fit. Therefore, when recycling the ink cartridge, the cover can be removed simply, which in turn can facilitate the replacement of the ink bag and waste ink absorbing member.

Here, in the front end wall 48 of the case outer frame portion 42 of the case main body 40, besides the above-mentioned securing holes 45 and fitting portions 42*a*, there are formed an insertion hole 48*a* into which the waste liquid needle 5 can be inserted, and two guide holes 48*b* and 48*c* into which positioning guide shafts can be inserted respectively when mounting the ink cartridge 2 into the cartridge mounting portion 3 of the ink jet printer 1. Also, at the position of the front end wall 523 of the inner frame portion 52 of the cover 50 that corresponds to the guide hole 48*a* of the case main body 40, there is provided a take-in port rubber 522 into which the waste needle 5 can be inserted.

Next, description will be given below of the plastic film 60 defining the division room 70 for storing the waste ink absorbing member 20. At first, as shown in FIG. 3 (A), the four peripheral edge portions of the plastic film 60 are connected by thermal welding to the opening end face 521 of the inner frame portion 52 of the cover 50 in such a manner that they are kept airtight to the end face 521.

And, the plastic film 60, as shown in FIG. 3 (B), is a film of a three-layer structure, while the first film layer 611 thereof is formed of the same plastic material as the cover 50 to which the plastic film 60 is to be thermally welded. As the material of the cover 50, there is used polystyrene having permeability (vapor permeability) in order to enhance the ink absorbing property of the ink absorbing material or plastic film 60. The reason for this is as follows: that is, since water occupies 70 to 80% of the ink in volume, if the water can be discharged outside, then the plastic film 60 is able to absorb the waste ink in a larger amount corresponding to the water discharged. Therefore, the first film 611 is formed of polystyrene film layer.

A second film layer 612 of the plastic film 60, which is piled up on the surface of the first film layer 611, is a film formed of rubber-system material which is highly resistant to shocks; as the material of the second film layer 612, for example, there is used "Ebar" (trade name). Thus, the second film layer 612 has similar permeability to polystyrene.

A third film layer 613 of the plastic film 60, which is piled up on the surface of the second film layer 612, is composed of a PET film, so that the third film layer 613 is higher in permeability than polystyrene.

For instance, the thickness of the first film layer 611 is 40 microns, the thickness of the second film layer 612 is 15 microns, and the thickness of the third film layer 613 is 12 microns. The three layers are to be bonded and fixed to one another with adhesives.

As described above, in the ink cartridge 2 according to the present embodiment, the division room 70 for storing the waste ink absorbing member 20 is defined by the cover 50 of the ink cartridge and the plastic film 60 thermally welded to the opening of the recess 53 formed in the back surface of the cover 50. Thanks to this, when compared with the conventional ink cartridge in which the division room for storing the waste ink absorbing member 20 is defined by the thick plastic plates, the present ink cartridge can be reduced in size and weight by an amount corresponding to use of the plastic film instead of the plastic plates.

Also, because of thermal welding of the plastic film to the cover, the division room 70 for storing the waste ink absorbing member 20 can be surely closed in an airtight manner, thereby eliminating the possibility that the collected waste ink can leak outside from the connected surface between the plastic film 60 and cover 50.

Further, if the flatness of the thermally welded surface of a cartridge case is poor, as in the conventional cartridge case, when a plastic plate is sealed by ultrasonic waves, there can occur poor welding. On the other hand, according to the present ink cartridge 2, when welding the plastic film thermally, for example, by inserting an elastic body such as rubber or the like between a heater and plastic film, the plastic film can be surely contacted with the thermally welded surface which is uneven and thus poor in flatness, so that it is difficult for poor thermal welding to occur. That is, it can be said that the present ink cartridge 2 is advantageous over the conventional ink cartridge in this respect as well.

Still further, when recycling the present ink cartridge, simply by peeling off the plastic film, the waste ink absorbing member with the waste ink absorbed therein can be replaced. Due to this, the ink cartridge can be recycled simply and also, since the recycling of the ink cartridge can be achieved simply by replacing only the old plastic film with a new one, the present ink cartridge is also economical.

In addition to the above, the surface of the plastic film on the side thereof to be thermally welded is formed of the same plastic material as the cover with which the plastic film is to be thermally welded. This makes it possible to enhance the connecting force that is obtained by means of the above thermal welding. Also, not only because the plastic film has permeability but also because the intermediate or second film layer of the plastic film is formed of the highly shock-resisting material, the shock resistance of the plastic film itself can also be improved. This is another advantage that can be provided by the present ink cartridge.

Here, the melting point of the first film layer on the side of the present plastic film to be thermally welded is in the range of 110–120° C., whereas the melting point of the third film layer (PET) on the side thereof to be contacted with the heater when thermally welded is 254° C. That is, since the melting point of the heater side film layer is set higher than that of the opposite side in this manner, it is possible to prevent the heater side film layer from melting and sticking to the heater in the thermally welding operation, which results in the improved efficiency of the thermally welding operation.

Moreover, generally, as the waste ink absorbing member 20 absorbs the ink, it swells; that is, the volume of the waste ink absorbing member 20 increases. However, according to the present embodiment, since the waste ink absorbing member 20 is partitioned by the plastic film of the division room 70 in which the waste ink absorbing member 20 is stored, the increase in the volume of the waste ink absorbing member 20 can be absorbed by the slackening of the plastic film. Especially, if the plastic film is mounted in a slackened manner, then such increase in the volume of the waste ink absorbing member 20 can be absorbed positively. Therefore, unlike the conventional ink cartridge in which the division room is partitioned by the plastic plates, it is not necessary that the division room has been previously formed rather large in expectation of an increase in the volume of the waste ink absorbing member, so that the ink cartridge can be made more compact by an amount corresponding to the reduced size of the division room.

Referring further to this respect, as in the present embodiment, when a division room for a waste ink absorbing member is partitioned by a plastic film, the waste ink absorbing member has a large ink (liquid) absorbing capacity, while it swells to a great extent when it absorbs the ink. For example, it is possible to use, as a waste ink absorbing member, a liquid-absorbing macromolecular polymer (a super-absorber) which is used in a paper diaper or the like. That is, when a division room for a waste ink absorbing member is partitioned by a plastic plate, although a macromolecular polymer is able to absorb ink, it is not allowed to swell, so that the actual ink absorption thereof is limited. On the other hand, when a plastic film is used, due to the slackening of the plastic film, the ink absorbing performance of a macromolecular polymer can be displayed to the full.

Here, the division room 70, which is formed on the back surface of the cover 50 of the ink cartridge 2 and also in which the waste ink absorbing member 20 is stored in a sealed manner, is a hermetically sealed space. However, if air cannot be exhausted from the hermetically sealed space, then there is a possibility that the ink absorbing performance of the waste ink absorbing member 20 can be lowered. To make sure to avoid such possibility, according to the present embodiment, as can be seen from FIG. 5 which will be discussed later, in a portion of the waste ink absorbing member 20 which is most distant from the take-in port rubber 522 that absorbs the ink last, there is formed a rectangular-shaped space (that is, a portion where the waste ink absorbing member is not present) 21; and, in a portion of the plastic film 60 which the space 21 faces, there is formed a ventilation hole 60.

Another Embodiment of Plastic Film

A plastic film which can be applied to the invention may be composed of a single film layer, instead of the above-mentioned three-layer structure. In this case, if the plastic film is formed of the same plastic material as the cartridge case, then the connecting force due to thermal welding can be improved. Of course, when the plastic film is connected by other means than thermal welding, the plastic film may also be formed of other kind of material.

Also, a plastic film may also be composed of two film layers. In this case, on the surface of the plastic film on the side thereof to be thermally welded, there may be disposed a first film layer which is formed of the same plastic material as the cartridge case, while a second film layer disposed on the opposite side to the first film layer may be formed of plastic material which is highly resistant to shocks. Of course, preferably, both of the two film layers may have permeability. By the way, a plastic film applicable to the invention can also be composed of four or more film layers.

Further, if the plastic film is so formed as to be transparent, there can be provided an advantage that the sealed condition thereof can be checked by observing the thermally welded surf ace of the plastic film visually after it is thermally welded.

Mounting Operation of Ink Cartridge

Next, description will be given below of an operation to mount the above-structured ink cartridge 2 onto the ink jet printer 1 with reference to FIG. 5. In the ink cartridge mounting portion 3 of the ink jet printer 1, there are formed upper and lower guide portions 31 and 32 which are used not only to guide the insertion of the ink cartridge 2 but also to hold the ink cartridge 2 at a given position. At the deepest position of the ink cartridge mounting portion 3, there is provided an end wall 33 which connects the upper and lower guide portions 31 and 32 to each other. On the end wall 33, there are disposed two guide shafts 34, 35, a base member 36 which is used to fix the ink support needle 4 formed of metal, the waste liquid needle 5, and two walls 37 which are used to position the insertion direction of the ink cartridge 2. By the way, the guide portions 31, 32, end wall 33, guide shafts 34,35, waste liquid needle 5, and walls 37 are molded of resin in such a manner that they form an integrally united body. On the back side of the end wall 33, the ink supply needle 4 is connected to the ink supply tube 7, whereas the waste liquid needle 5 is connected to the waste liquid tube 13.

The ink cartridge 2 is guided by the two guide portions 31 and 32 and is inserted in the direction of an arrow D. If the ink cartridge 2 is inserted further from the position thereof shown in FIG. 5, then the guide shaft 34 projecting from the end wall 33 is engaged with a guide hole 48*b* formed in the ink cartridge 2 and, at the same time, the guide shaft 35 projecting from the end wall 33 is engaged with a guide hole 48*c* formed in the ink cartridge 2, whereby the upper and lower as well as right and left positions of the ink cartridge 2 are decided. The respective leading ends of the guide shafts 34 and 35 are tapered to thereby facilitate the smooth insertion of the guide shafts 34 and 35 into their respective guide holes 48*b* and 48*c*. In order not only to prevent the ink supply needle 4 from reaching the ink take-out port 62 but also to prevent the waste liquid needle 5 from arriving at the take-in port rubber 522 in the current state, the respective projecting lengths of the guide shaft 34, guide shaft 35, ink supply needle 4 and waste liquid needle 5 have been previously set.

If the ink cartridge 2 is inserted still further, then the ink supply needle 4 passes through the take-out port rubber 624 and reaches the ink stored within the ink bag 6. Almost at the same time, the waste liquid needle 5 passes through the take-in port rubber 522 and is inserted into the waste ink absorbing member 20 disposed within the ink cartridge 2.

Referring further to the ink cartridge 2 that is inserted in the arrow D direction, the front surface 48 thereof is finally contacted with the walls 37 which are formed in the periphery of the base member 36, so that the ink cartridge 2 is fixed at this position by a lock member (not shown). In this state, the ink bag 6 disposed within the ink cartridge 2 is allowed to communicate with the print head 9 through the ink supply tube 7, while the waste ink absorbing member 20 is connected to the waste liquid tube 13. Also, the take-out port rubber 624 is closely contacted with the side surface of the ink supply needle 4 to thereby prevent the ink from leaking out from the ink bag 6, while the take-in port rubber 522 is closely contacted with the side surface of the waste liquid needle 5 to thereby prevent the waste liquid from leaking externally of the ink cartridge 2 from the waste ink absorbing member 20.

Also, to remove the ink cartridge 2 from the ink cartridge mounting portion 3 of the ink jet printer 1, the locking or fixation of the ink cartridge 2 by the lock member (not shown) is removed and then the ink cartridge 2 is moved in the opposite direction to the arrow D direction. Due to this, the ink supply needle 4 is removed from the take-out port rubber 624 and the waste liquid needle 5 is removed from the take-in port rubber 522 and, after then, the engagement between the guide shaft 34 and guide hole 48*b* as well as the engagement between the guide shaft 35 and guide hole 48*c* are respectively removed, so that the ink cartridge 2 is guided by the two guide shafts 34 and 35 and is thus moved parallel to the ink supply needle 4 and waste liquid needle 5. This parallel movement of the ink cartridge 2 prevents an undesirable force from being applied to the ink supply needle 4 and waste liquid needle 5 in the upper and lower as well as right and left directions.

By the way, according to the present embodiment, the waste liquid needle 5 is a resin needle which is formed integrally with the ink cartridge mounting portion 3 of the ink jet printer 1. However, this is not limitative but, according to the invention, similarly to the ink supply needle 4, the waste liquid needle 5 can also be formed of metal.

Another Embodiment of Ink Absorbing Member

Generally, when the ink cartridge is not used for a long time after it is mounted into the ink jet printer, the ratio of the ink to be consumed for cleaning to the ink to be used for printing increases. For this reason, in an ink cartridge mounted in a printer which is used with low frequency, when compared with an ink cartridge mounted in a printer which is used with high frequency, a large amount of waste ink is collected. In other words, the amount of waste ink absorbed and collected by a waste ink absorbing member within an ink cartridge used varies according to the using conditions of printers.

Figure 7:
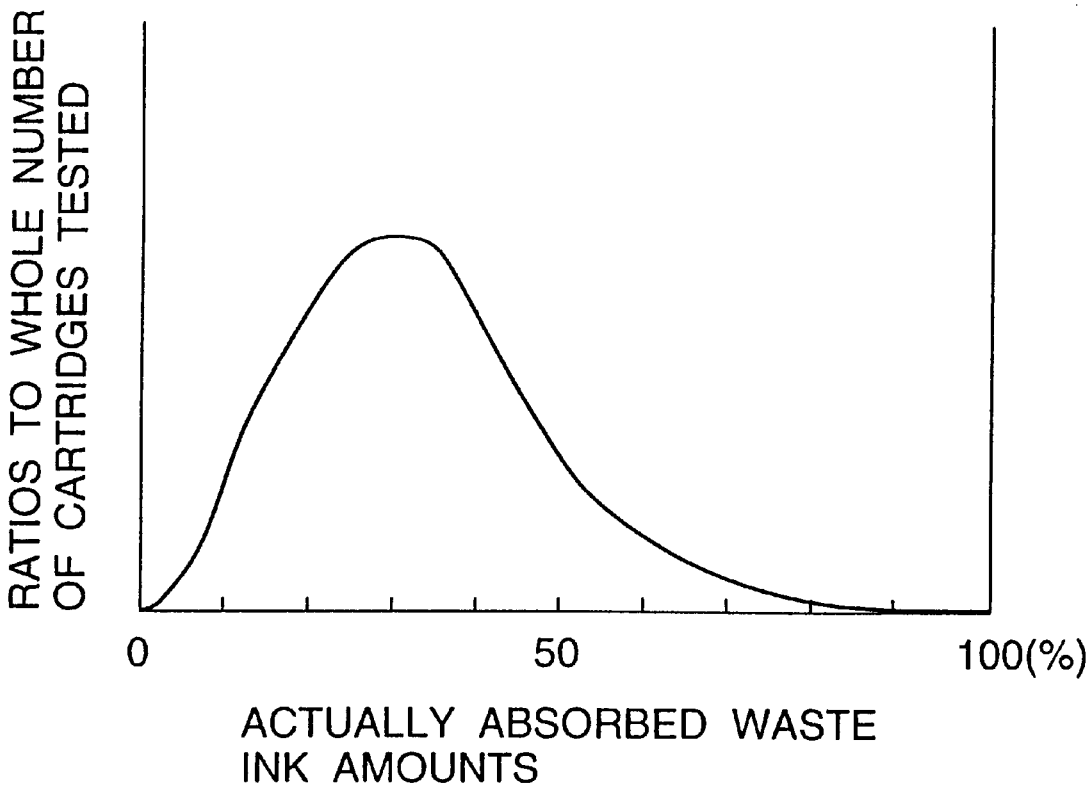
FIG. 7 is a frequency distribution curve to show the waste ink absorbed amounts of waste ink absorbing members after used, while the curve is based on the data that have been obtained from a test which was conducted using dozens of ink cartridges.

Now, FIG. 7 shows a frequency distribution curve which is obtained from the results of a test in which dozens of ink cartridges were used and checked for the waste ink absorbing amounts of the waste ink absorbing members of the ink cartridges after they had been used. In particular, in the test, there were used ink bags in each of which ink of the order of 110 cc is stored, and ink cartridges each of which includes an ink absorbing member having a volume of the order of 110 $cm^3$. The ink cartridges were mounted in a large number of printers, the printers were used with various using frequencies, the cartridges were collected at the time when the ink is used up, and the amounts of waste ink collected by the waste ink absorbing members of the ink cartridges were measured.

Here, referring to FIG. 1, the horizontal axis of a graphical representation shown in FIG. 7 shows ratios of the actually absorbed waste ink amounts of the waste ink absorbing members to the maximum waste ink absorbing amounts of the waste ink absorbing members (that is, the ratios of use of the waste ink absorbing members). In particular, if the horizontal axis shows 0%, then it means that the waste ink is not collected at all; and, if it shows 100%, then it means that the waste ink is collected up to saturation. On the other hand, the vertical axis of FIG. 7 shows the frequency of the ink cartridges, which belongs to the use ratios of the waste ink absorbing members thereof, to the whole number of the ink cartridges used in the test.

As can be understood clearly from the graphical representation shown in FIG. 7, no ink cartridge belongs to the use ratio of its waste ink absorbing member of 100% and, in most of the ink cartridges, the waste ink is collected in such a manner that the waste ink absorbing member use ratio becomes 20–50%. That is, this shows that, in these waste ink absorbing members, there are still left portions which are capable of absorbing the waste ink further.

Now, description will be given below of preferred embodiments of an ink absorbing member which make it possible to provide an ink cartridge that can be recycled more economically, with reference to FIGS. 8 to 11.

Figure 8:
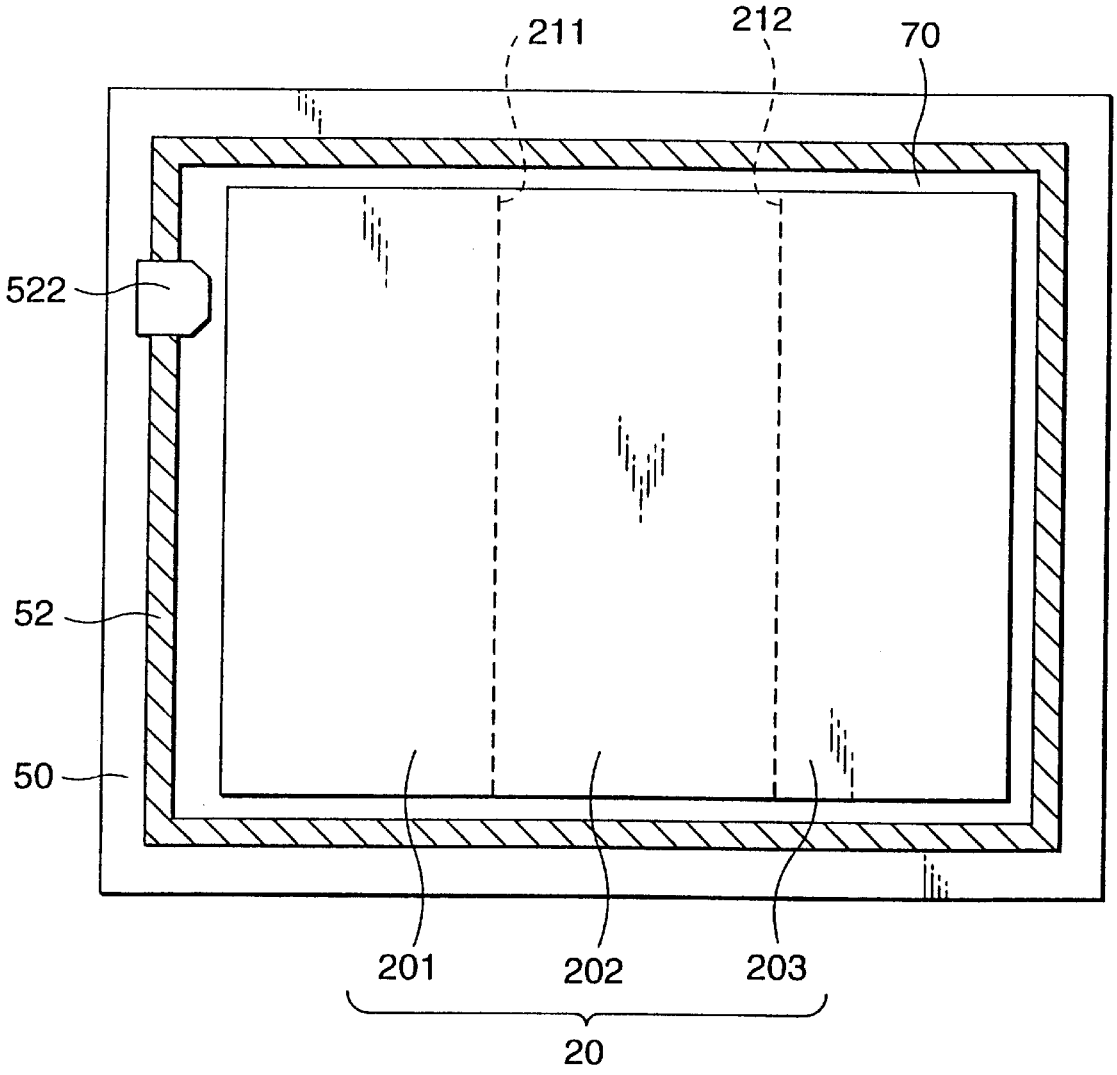
FIG. 8 is a plan view of a first embodiment of an ink absorbing member mounted in a division room 70.
Figure 9:
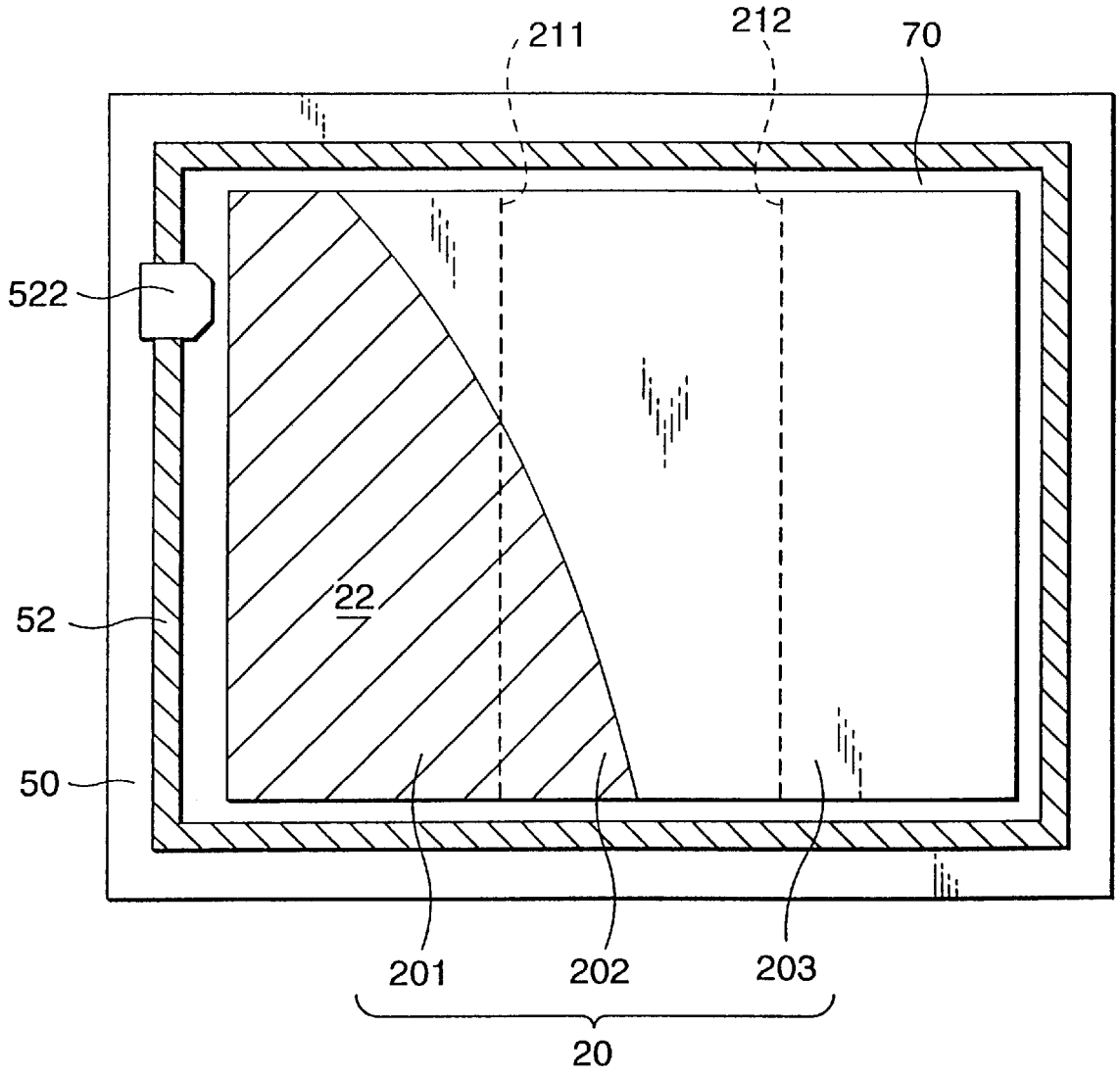
FIG. 9 is a plan view of the ink absorbing member shown in FIG. 8, showing a state thereof after it is used.

FIGS. 8 and 9 respectively show an embodiment of an ink absorbing member and, in particular, FIGS. 8 and 9 are plan views of the ink absorbing member which is mounted in the division room 70. In more particular, FIG. 8 shows a state of the ink absorbing member before it is used, whereas FIG. 9 shows a state thereof after it is used.

In the ink absorbing member according to the present embodiment, as shown FIGS. 8 and 9, there have been previously formed two perforation-shaped breaks 211 and 212, while the present ink absorbing member can be easily divided along the two perforations into three ink absorbing member sections 201, 202 and 203. In the present embodiment, the two perforations are set in such a manner that they are almost parallel to the side surface of the ink absorbing member 20 on the side thereof where the take-in port rubber 522 is disposed. Also, the two perforations 211 and 212 are formed in such a manner that, when the ink absorbing member 20 is divided, the three absorbing member sections 201, 202 and 203 are almost equal in shape to one another.

The waste ink is fed through the take-in port rubber 522 and is then absorbed by the waste ink absorbing member 20 which is stored within the division room 70. And, each time the ink suction and cleaning are repeatedly executed, the ink is penetrated little by little into the ink absorbing member 20 and the ink is used on and from the absorbing member section 201 side of the take-in port rubber 522. The ink is repeatedly used in printing, the ink used is cleaned as the need arises, and, when the ink of the ink bag 6 is used up, the waste ink 22 collected is stored in the ink absorbing member, for example, in such a manner as shown in FIG. 9.

To recycle an ink cartridge in which the waste ink 22 is stored in this manner, the ink absorbing member 20 may be cut at the perforation 212, the thus cut absorbing member sections 201 and 202 portions thereof may be replaced, whereas the absorbing member section 203 portion of the ink absorbing member 20, which is not contaminated by the waste ink at all, can be used again as it is. Of course, if the absorbing member section 202 is not contaminated, then the ink absorbing member 20 may be cut at the perforation 211, and only the absorbing member section 201 portion thereof may be replaced.

By the way, as described before, in most of the ink cartridge, the use ratio of the waste ink absorbing member falls within the range of 20–50% and, therefore, the absorbing member 203 can be scarcely contaminated. However, in order to be able to prevent the ink from leaking out of the ink absorbing member 20 into a printer even when most of the ink is collected by cleaning due to the malfunction of the printer or the like, the ink absorbing member 20 is endowed with an ability to absorb 90% or more of the ink stored within the ink bag 6.

Figure 10:
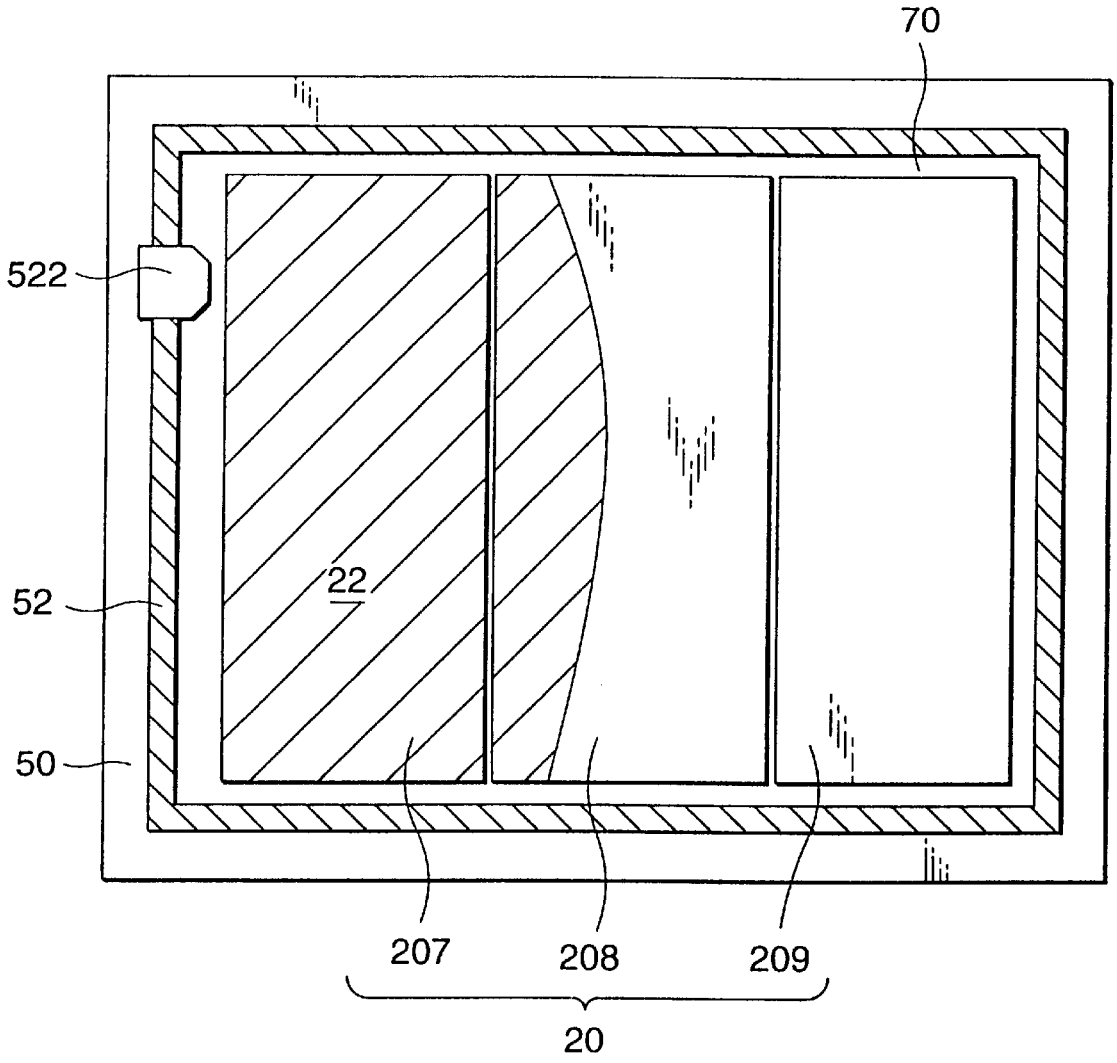
FIG. 10 is a plan view of a second embodiment of an ink absorbing member mounted in the division room 70, showing a state thereof after it is used; and, FIG. 11 is a plan view of a third embodiment of an ink absorbing member mounted in the division room 70, showing a state thereof after it is used.

Now, FIG. 10 shows another embodiment of the ink absorbing member and, in particular, FIG. 10 is a plan view of the ink absorbing member mounted in the division room 70, showing a state thereof after it is used. In the previously-mentioned embodiment of the ink absorbing member, there has been illustrated a structure in which the perforations are formed in the ink absorbing member so as to be able to divide the same easily. Also, in the present embodiment in which three previously divided ink absorbing members 207, 208 and 209 are arranged side by side within the division room 70, a similar effect to the previously mentioned embodiment can also be obtained.

Figure 11:
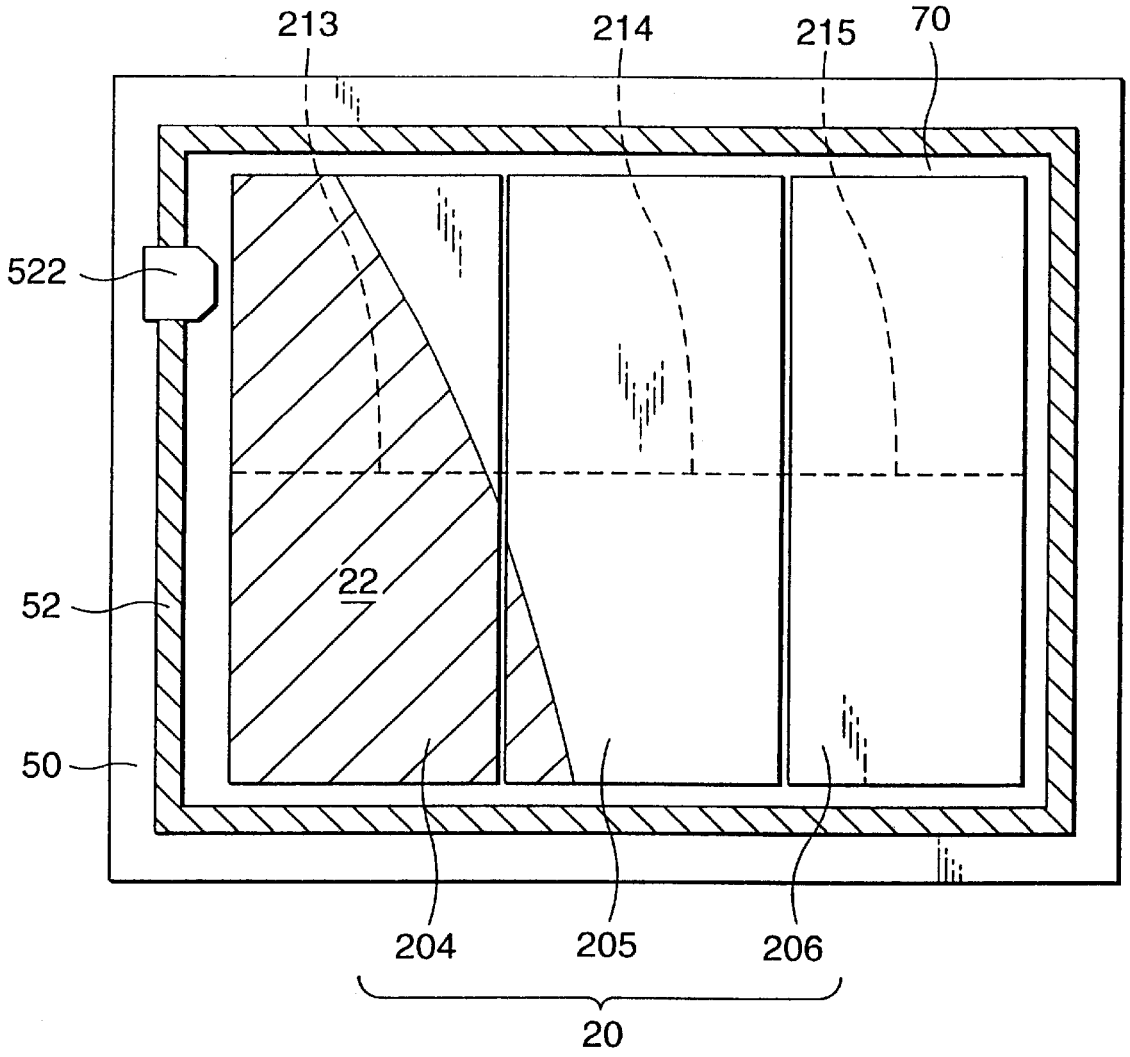

Also, as shown in FIG. 11, the break 21 is not always limited to the perforation-shaped break but, of course, other types of break such as a break composed of a V-shaped groove or the like can also be used, provided that it allows the ink absorbing member to be divided easily.

Therefore, if the ink absorbing member is formed in the above-mentioned manner, the quantities of the waste ink absorbing members 20 to be wasted can be reduced, which in turn can reduce the cost necessary to dispose of the waste and also can decrease the ill effects of the waste on the environment. Also, since the quantities of new waste ink absorbing members 20 to be supplied into the ink cartridge in recycling operations can be reduced, the cost of the ink cartridge can be decreased.

What is claimed is:

1. An ink cartridge with a waste ink absorbing function, comprising an ink bag with ink stored therein, a waste ink absorbing member for absorbing waste ink, and a cartridge case storing therein the ink bag and waste ink absorbing member, said ink cartridge including a division room formed in an interior portion of said cartridge case for storing said waste ink absorbing member therein, and a plastic film forming at least a portion of said division room, said cartridge case including first and second case sections which combine together to thereby define the storage portions of said cartridge case respectively for storing said ink bag and said waste ink absorbing member, wherein said first case section includes a rectangular-shaped case bottom plate portion and a case outer frame portion formed in a peripheral edge of said case bottom plate portion, said second case section includes a rectangular-shaped case cover portion and a case inner frame portion formed in a peripheral edge of said case cover portion, and said case inner frame portion is smaller in width than said case outer frame portion and is formed in a size which allows said case inner frame portion to be inserted into said case outer frame portion, and also wherein said waste ink absorbing member is stored within a rectangular-shaped recess to be defined by said case cover portion and said case inner frame portion of said second case section, and the opening of said recess is closed by said plastic film to thereby define said division room.

2. An ink cartridge with a waste ink absorbing function as set forth in claim 1, wherein said first and second case sections are combined together in a removable manner.

3. An ink cartridge with a waste ink absorbing function as set forth in claim 2, wherein the peripheral edge portion of said plastic film is thermally welded to the opening end face of said case inner frame portion defining said opening of said recess.

4. An ink cartridge with a waste ink absorbing function as set forth in claim 3, wherein there is formed a ventilation hole in said plastic film.

5. An ink cartridge with a waste ink absorbing function as set forth in claim 4, wherein said ventilation hole is formed in the portion of said plastic film that faces the portion of said waste ink absorbing member where waste ink is absorbed latest in time.

6. An ink cartridge with a waste ink absorbing function as set forth in claim 3, wherein said plastic film is transparent.

7. An ink cartridge with a waste ink absorbing function as set forth in claim 1, wherein said cartridge case is formed of plastics, and said plastic film has a permeability equivalent to at least that of said cartridge case.

8. An ink cartridge with a waste ink absorbing function as set forth in claim 3, wherein said plastic film is formed of the same material as said cartridge case and is thermally welded to said cartridge case.

9. An ink cartridge with a waste ink absorbing function as set forth in claim 1, wherein said waste ink absorbing member is formed of material which increases in volume as it absorbs ink, and said plastic film is flexible and forms a portion of said division room.

10. An ink cartridge with a waste ink absorbing function as set forth in claim 1, wherein said waste ink absorbing member is previously divided into a plurality of ink absorbing member sections and said plurality of divided ink absorbing member sections are stored within said division chamber.

11. An ink cartridge with a waste ink absorbing function as set forth in claim 1, wherein said waste ink absorbing member includes one or more breaks previously formed in order to be able to divide said ink absorbing member into a plurality of ink absorbing member sections.

12. An ink cartridge with a waste ink absorbing function, comprising an ink bag with ink stored therein, a waste ink absorbing member for absorbing waste ink, and a cartridge case storing therein the ink bag and waste ink absorbing member, said ink cartridge including a division room formed in an interior portion of said cartridge case for storing said waste ink absorbing member therein, and a plastic film forming at least a portion of said division room, said cartridge case being formed of plastics, wherein said plastic film includes first and second film layers, and said first film layer is formed of the same material as said cartridge case and is thermally welded to said cartridge case.

13. An ink cartridge with a waste ink absorbing function as set forth in claim 12, wherein said plastic film further includes a third film layer interposed between said first and second film layers or piled on the surface of said second film layer, and said third film layer is higher in shock resistance than said first and second film layers.

14. An ink cartridge with a waste ink absorbing function as set forth in claim 12, wherein the melting temperature of said second film layer is higher than the melting temperature of said first film layer.

15. An ink cartridge, comprising:

a fresh ink compartment having a bottom plate portion and a first frame portion formed in a peripheral edge of the bottom plate portion;

an ink bag with fresh ink stored in the fresh ink compartment;

a waste ink compartment formed by a portion of interior walls of the ink cartridge and by a flexible plastic film, the plastic film dividing the fresh and waste ink compartments, the waste ink compartment having a cover portion and a second frame portion formed in a peripheral edge of the cover portion; and a waste ink absorbing member stored in the waste ink compartment.

16. An ink cartridge as set forth in claim 15, wherein said fresh ink compartment and said waste ink compartment together comprise a cartridge case for storing therein the ink bag and the waste ink bag.

17. An ink cartridge as set forth in claim 16, wherein said fresh ink compartment and said waste ink compartment are combined together in a removable manner.

18. An ink cartridge as set forth in claim 15, wherein said cartridge case is formed of plastics, and said plastic film has a permeability equivalent to at least that of said cartridge case.

19. An ink cartridge as set forth in claim 18, wherein said plastic film is formed of the same material as said cartridge case and is thermally welded to said cartridge case.

20. An ink cartridge as set forth in claim 16, wherein said plastic film has a ventilation hole.

21. An ink cartridge as set forth in claim 16, wherein said ventilation hole is formed in the portion of said plastic film that faces the portion of said waste ink absorbing member where waste ink is absorbed latest in time.

* * * * *